US007615124B2

(12) United States Patent
Dupoiron et al.

(10) Patent No.: US 7,615,124 B2
(45) Date of Patent: Nov. 10, 2009

(54) METHOD FOR MAKING A PLATED STEEL ARMOURING WIRE FOR A FLEXIBLE TUBULAR PIPE TRANSPORTING HYDROCARBONS, AND ARMOURED PIPE

(75) Inventors: Francois Dupoiron, Barentin (FR); Philippe Espinasse, Bihorel (FR)

(73) Assignee: Technip France (FR)

( * ) Notice: Subject to any disclaimer, the term of this patent is extended or adjusted under 35 U.S.C. 154(b) by 770 days.

(21) Appl. No.: 10/506,267

(22) PCT Filed: Feb. 28, 2003

(86) PCT No.: PCT/FR03/00657

§ 371 (c)(1),
(2), (4) Date: Dec. 9, 2004

(87) PCT Pub. No.: WO03/074206

PCT Pub. Date: Sep. 12, 2003

(65) Prior Publication Data

US 2005/0089637 A1 Apr. 28, 2005

(30) Foreign Application Priority Data

Mar. 5, 2002 (FR) ..... 02 02793

(51) Int. Cl.
*C21D 9/60* (2006.01)
*C21D 9/42* (2006.01)
*C21D 8/06* (2006.01)

(52) U.S. Cl. ..... 148/529; 148/526; 148/530; 148/537; 148/599; 148/568; 148/598; 148/595

(58) Field of Classification Search ..... 148/595–600, 148/568, 525, 526, 529, 530, 537; 428/682–685, 428/606, 607

See application file for complete search history.

(56) References Cited

U.S. PATENT DOCUMENTS 3,261,724 A * 7/1966 Ulam ..... 148/531

(Continued)

FOREIGN PATENT DOCUMENTS

GB 1 230 489 A 5/1971
GB 2 085 330 A 4/1982

(Continued)

OTHER PUBLICATIONS

Computer-generated English translation of Japanese patent 06-057367, Kawachi et al. Mar. 1, 1994.*

(Continued)

*Primary Examiner*—Deborah Yee
(74) *Attorney, Agent, or Firm*—Ostrolenk Faber LLP

(57) ABSTRACT

A process for manufacturing plated-steel armor wires intended for reinforcement of flexible tubular pipes for transporting hydrocarbons, comprising a plating coating is intimately bonded, by high pressure, to a core made of hardenable steel with moderate mechanical properties, and then the plated wire obtained undergoes a rapid high-temperature hardening step followed by a tempering step.

10 Claims, 2 Drawing Sheets

U.S. PATENT DOCUMENTS

| | | | | | |
|---|---|---|---|---|---|
| 3,522,111 | A | * | 7/1970 | Simmons et al. | 148/534 |
| 4,590,752 | A | | 5/1986 | Aubert et al. | |
| 4,913,751 | A | * | 4/1990 | Schmitt et al. | 148/320 |
| 5,503,608 | A | * | 4/1996 | Chang | 482/57 |
| 6,106,637 | A | * | 8/2000 | Arnaud et al. | 148/320 |

FOREIGN PATENT DOCUMENTS

| | | | | |
|---|---|---|---|---|
| JP | 60 255923 | A | | 12/1985 |
| JP | 61126922 | | * | 6/1986 |
| JP | 404115956 | | * | 4/1992 |
| JP | 2000 271639 | A | | 10/2000 |

OTHER PUBLICATIONS

Derwent Acc-No. 2001-317150, English abstract of Chinese patent 1244595, Guo X et al.*

English abstract of Japanese patent 49088713, Hitachi Metals LTD, Aug. 24, 1974.*

English abstract of Soviet Union 643547, Moscow Steel Alloys Institute, Kiparisov et al., Jan. 30, 1979.*

Askland, Donald R.: "The Science and Engineering of Materials" 1984, Brooks/Cole Engineering Division Monterey (US) XP002251518 p. 364, line 5—p. 366; figure 13.14.

International Search Report for International Application No. PCT/FR03/00657.

* cited by examiner

METHOD FOR MAKING A PLATED STEEL ARMOURING WIRE FOR A FLEXIBLE TUBULAR PIPE TRANSPORTING HYDROCARBONS, AND ARMOURED PIPE

BACKGROUND OF THE INVENTION

The present invention relates to the field of flexible tubular pipes for transporting hydrocarbons, especially unbonded flexible pipes. These pipes are defined in the recommendations API 17J and 17B of the American Petroleum Institute and comprise metal layers and separate polymeric layers, that is to say layers that are not bonded together so as to allow certain relative displacement between the layers.

More precisely, an unbonded pipe of the type intended in the invention generally comprises, from the inside to the outside:

an internal sealing sheath made of a plastic, generally a polymer, resistant to the chemical action of the fluid to be transported;

optionally, a pressure vault resistant mainly to the pressure developed by the fluid in the sealing sheath and consisting of the winding of one or more interlocked metal profiled wires (which may or may not be self-interlockable) that are wound in a helix with a short pitch (i.e. with a winding angle close to 90° with respect to the axis of the pipe); the profiled wires have a cross section in the form of a Z or a T, or derivatives (theta or zeta) thereof, or a U or an I;

at least one ply (and generally at least two crossed plies) of tensile armor wires wound with a long pitch—the lay angle measured along the longitudinal axis of the pipe is, for example, approximately equal to 55°; and optionally, an external protective sealing sheath made of a polymer.

Such a pipe may be what is called a "smooth bore" pipe when the bore is formed directly by the sealing sheath or what is called a "rough bore" pipe when a carcass consisting of an interlocked metal strip wound in a short pitch is also provided inside the internal sealing sheath, said carcass serving to prevent the pipe from collapsing under the external pressure. When a carcass is used, it is possible for certain applications to dispense with the pressure vault.

Optionally, the pipe may include, in addition to these layers, other special layers, a metal hoop (wound in a short pitch) and forming part of the pressure vault, intermediate polymeric sheaths, etc.

The precise construction, number and arrangement of the various layers are carefully chosen depending on the applications and the operating conditions of the pipe, but in all the pipes there are layers formed by windings of steel reinforcing or armor wires.

For deep-sea applications, which are the intended main applications of the invention, the pipe generally comprises all of the following: a carcass, a sealing sheath, a pressure vault, tensile armor plies and an external sealing sheath.

Within the meaning of the present invention, the armor wires in question are the tensile armor wires of the crossed armor plies or else possibly the profiled wires or the hoop wires of the pressure vault, which will be called pressure armor wires. By extension, armor wire will also be understood to mean a profiled wire which is obtained by the process of the invention and would be intended to be used for manufacturing a carcass.

When the pipes are intended to operate in an acid corrosive medium (especially because of the $H_2S$ contained in the effluents transported), which is often called in the oil industry jargon a "sour" medium, it is necessary to adopt special measures in order to guarantee the corrosion resistance of the armor (tensile and pressure) wires. These measures and the grades of steels that are necessary are defined in the NACE (National Association of Corrosion Engineers) standard MR01-75 governing the corrosion resistance in sour medium of steels and alloys.

Usually, steels with good $H_2S$ corrosion resistance have relatively poor mechanical properties ($R_m$<850 MPa). Now, if the envisioned operating conditions are both corrosive and deep sea, it is necessary to preserve the mechanical properties of the metal wires, especially the armor wires, which will be subjected both to corrosion and to the high tensile forces encountered (for a seabed flowline transport pipe, these high tensile forces not perhaps occurring during the life of the pipe once laid, but at least while the pipe is being laid). If the steel does not have very good mechanical properties, it is necessary to increase the steel thicknesses used, which increases the weight of the pipes, the size of the winding and laying equipment and therefore the manufacturing cost of the pipes.

According to document FR 2 775 050, which relates to an unbonded flexible pipe intended for static use in a corrosive environment, a steel resistant to $H_2S$ corrosion but with moderate mechanical properties is used for the armor wires of the pressure vault, while a steel having high mechanical properties but not resistant to sour corrosion is used for the tensile armor plies. This compromise appears acceptable if the $H_2S$ corrosion cannot reach the tensile armor plies; for this purpose, an intermediate $H_2S$ confinement sheath separates the pressure vault, which will undergo $H_2S$ corrosion, from the tensile armor plies, which in principle will not undergo this corrosion. However, safety is not guaranteed because of the risks of the intermediate sheath being pierced. Moreover, the poor mechanical properties of the steel used for the pressure vault mean that they have to be oversized.

In the field of bonded pipes, the document FR 2 569 461 discloses a rubber hose intended for transporting corrosive effluents and incorporating, for this purpose, reinforcements consisting of layers of embedded metal cables, the cables consisting of steel wires coated with plated aluminum (that is to say with intimate bonding to the steel, obtained under high application pressure, for example by coextrusion). This hose, manufactured using the technology of bonded pipes, therefore has a construction different from that of the unbonded pipes mainly envisioned according to the invention, which are subjected to tensile stresses that cannot be envisioned with this bonded pipe technology. If the aim is to retain the beneficial concept of using plated armors in pipes of the type more particularly considered in the present invention, it is necessary to envision plating the metal wire, which has high mechanical properties ($R_m$ greater than 1000 MPa and preferably greater than 1400 MPa), with a corrosion-resistant coating. However, the use of such high-mechanical-performance metal wires coated with an anticorrosion plating is not entirely satisfactory, especially because of a difficulty arising from the fact that the intimate bond between the coating and the steel is brittle and cannot withstand the stresses associated with the actual pipe manufacture.

SUMMARY OF THE INVENTION

The object of the invention is to be able to reinforce flexible pipes, especially unbonded pipes, with armor wires that are corrosion resistant but also have good mechanical properties in order to allow the pipes to be used at great depth. More precisely, the objective of the invention is to find a process for intimately coating or plating the steel of the armor wires that is compatible with the requirements of the use of a pipe of the aforementioned type in a sour medium and at great depth.

The invention achieves its objective thanks to a process for manufacturing plated-steel armor wires intended for the reinforcement of flexible tubular, in particular unbonded, pipes for transporting hydrocarbons, of the type in which a plating coating is intimately bonded, by high pressure, to a steel core, characterized in that the steel of the core is chosen with moderate mechanical properties and is hardenable, in that the coating is applied to the core and intimately bonded thereto and then in that in the plated wire obtained undergoes a rapid high-temperature hardening step followed by a tempering step, so as to increase the mechanical properties of the plated wire.

The properties of the steel and of the plating coating, and also the time and temperature of the hardening step are chosen in a linked manner so as to raise the mechanical properties of the hardened wire without destroying the strength of the plating bond. One of the key factors of the invention is the rapidity of the high-temperature heat treatment which, in conjunction with the other parameters, makes it possible to minimize the stresses at the bond between the steel and the coating, especially by preventing the migration of carbon and iron from the steel into the bond and the coating.

According to the invention, a steel of medium strength is used for the core of the armor wire, that is to say a steel whose strength $R_m$ is between 500 and 1000 MPa, advantageously between 800 and 900 MPa. This must be a carbon, alloy or low-alloy steel that is "hardenable" (i.e. able to undergo hardening to improve its mechanical properties, the hardening consisting, as is known, of heat treatment hardening: austenization+cooling).

The anticorrosion coating is, for example, made of titanium or titanium alloys, stainless steel, nickel or nickel alloys.

The plating is carried out cold, by mechanical means, after suitable preparation (mechanical or chemical deoxidation of the surfaces), using a technique that allows intimate pressure bonding (for example coextrusion or corolling).

After this operation, what is obtained is an assembly characterized by a base/plating bond that is still brittle and by mechanical properties degraded by a plastic deformation (low elongation). At this stage, such a product would not be compatible with a forming operation in order to serve as armor for a pipe of the type considered in the invention.

According to the invention, the steel thus coated is subjected to a heat treatment comprising a short high-temperature hardening step and a tempering step that are carried out so as to minimize the stresses at the bond between the steel and the coating.

The heat treatment according to the invention makes it possible to improve the properties of the bond, to restore the ductility properties of the plating and to obtain high mechanical properties of the base metal that are needed in the envisioned applications of this type of product.

This heat treatment is characterized by a short (a few seconds to a few tens of seconds) high-temperature (900° to 1100° C.) thermal cycle followed by rapid cooling and a tempering treatment at a temperature of around 400° C. to 700° C., this temperature being adjusted according to the desired mechanical properties, the tempering step being carried out over a period of a few minutes, advantageously between 10 and 20 minutes.

This heat treatment has the following effects, which differ depending on the constituents of the armor:

in respect of the plating, the treatment restores the ductility without causing any precipitation prejudicial to corrosion resistance;

in respect of the bond, it improves the strength, by relaxation of the rolling or extrusion stresses and by metal diffusion. The tempering additionally improves the ductility, by relaxation of the differential stresses associated with the tempering step; and in respect of the base metal, the heat treatment makes it possible to obtain a hardened-tempered structure that combines very high mechanical properties ($R_m$ greater than 1000 MPa and preferably greater than 1400 MPa at least) with a ductility (about 5% elongation) sufficient for the intended applications.

The invention also relates to a flexible tubular pipe for transporting hydrocarbons, which incorporates at least certain armor wires manufactured by the aforementioned manufacturing process. More precisely, the invention relates to a flexible tubular pipe for transporting hydrocarbons, of the type comprising unbonded metal layers and polymeric layers, the metal layers comprising wound armor wires, characterized in that certain of the armor wires are manufactured according to the process of the invention. The invention relates especially to a pipe of the type comprising at least a carcass, an internal sheath, a pressure vault having pressure armor wires, plies consisting of tensile armor wires, and an outer sheath, characterized in that at least certain of the armor wires are manufactured according to the process of the invention.

Other advantages and features will become apparent on reading the following description, with reference to the appended schematic drawings,

DESCRIPTION OF PREFERRED EMBODIMENTS

Figure 1:
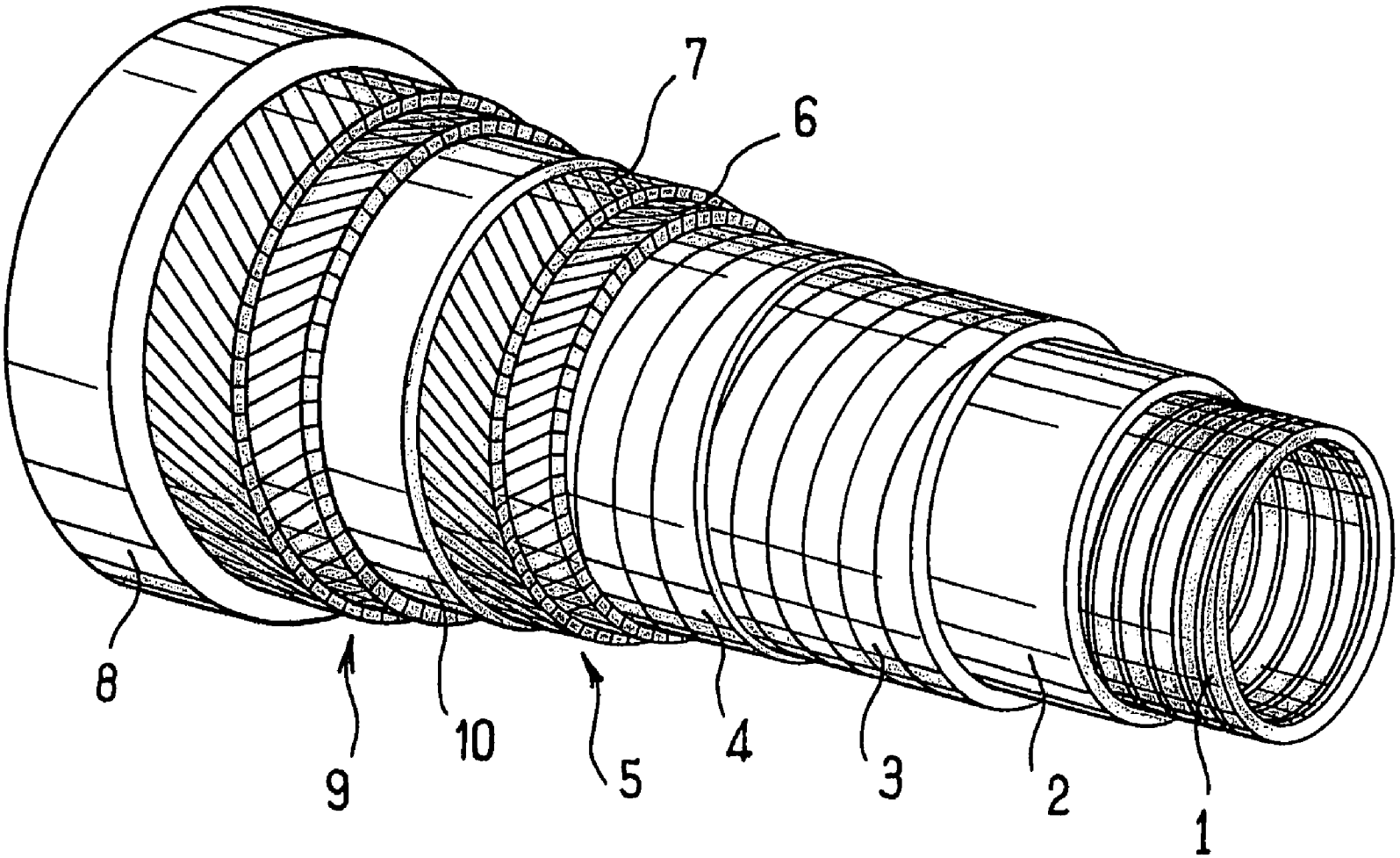
FIG. 1 is a perspective view of a rough-bore pipe to which the invention applies.

FIG. 1 shows a rough-bore pipe which comprises, from the inside to the outside: a metal carcass 1, generally formed by an interlocked steel strip wound in a short pitch and intended to withstand being crushed under the external pressure; a polymeric internal sealing sheath 2, a metal pressure vault, conventionally consisting here of the winding of an interlocked profiled wire 3 wound in a helix with a short pitch (with a winding angle generally close to 90° with respect to the axis of the pipe), this winding being covered by the winding of a hoop wire 4 wound in a helix of short pitch; armoring 5 resistant to the axial tension in the longitudinal direction of the pipe and conventionally consisting of a pair of crossed plies of tensile armor wires 6, 7 wound with a long pitch (typically at an angle of less than 55° to the axis of the pipe); and a polymeric external sealing sheath 8. Other layers, such as another armoring 9 and an intermediate sheath 10, may be provided depending on the type and application of the pipe.

Figure 2:
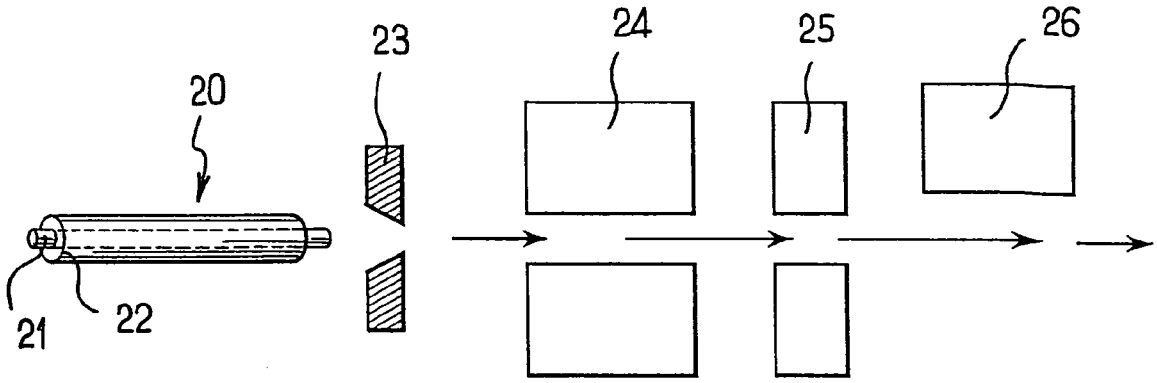
FIG. 2 is a schematic view illustrating the process for manufacturing the plated armor according to the invention.

The invention relates to the plating of the tensile armor wires 6, 7 and also of the pressure armor wires 3, 4 (as the case may be), according to a treatment that is illustrated in FIG. 2.

The starting wire 20 has a core 21, made of a base metal of moderate mechanical properties (for example $R_m$ of 800 to 900 MPa), and a coating 22 made of plating metal. The base metal may, for example, be a base steel of the silicon-chromium (55SiCrV) type in the spheroidized state so as to allow plating. The plating metal may for example be a nickel base (NiCrMo, series 6x according to the AISI) or a nickel alloy (series 8x). The starting wire 20 passes through a coextrusion die 23, from which it emerges with the coating 22 intimately bonded to the core 21. The wire thus plated passes through a station 24 for high-temperature heat treatment, typically at least 800° C. and preferably at least 1100° C., for example by induction heating of the wire. This treatment is rapid (lasting a few seconds to a few minutes at the very most). Austenization of the base steel takes place during the treatment, which is followed by a rapid quench in a quenching station 25 (for example an air, water or oil quench) which is accompanied by a controlled martensitic transformation and therefore allows high mechanical properties to be obtained, with an $R_m$ of around 2000 MPa. However, the speed of the treatment prevents harmful elements (iron and carbon) from diffusing into the bond, which would degrade the quality thereof and would degrade the corrosion resistance of the plating. Induction heating is advantageous not only for its rapidity but also because it gets around the problems associated with any reflection of the coating.

The wire thus obtained then passes through a thermal tempering station 26, at a temperature of around 450° C. for about 15 minutes.

It is possible, after the corolling or coextrusion plating in the station 23 and before the heat treatment in the station 24, to provide an intermediate tempering treatment, for example allowing the ductility and the quality of the bond to be restored.

It is advantageous to ensure that the mechanical properties of the core 21 and the coating 22 are appropriate, by choosing properties that are relatively similar. The constituent materials will preferably be chosen so that the difference between their respective mechanical strength ($R_m$) properties is no greater than 200 MPa. By keeping this difference between the wire and the coating relatively small, the uniformity of coating thickness distribution is improved and the quality of the bond obtained is also improved.

It is possible to provide several plating layers. The thickness of the plating is generally around 200 μm to 500 μm. It must be thick enough to withstand mechanical attack and to be corrosion resistant. It represents, in cross section, less than about 10% of the total cross section of the wire.

Figure 3:
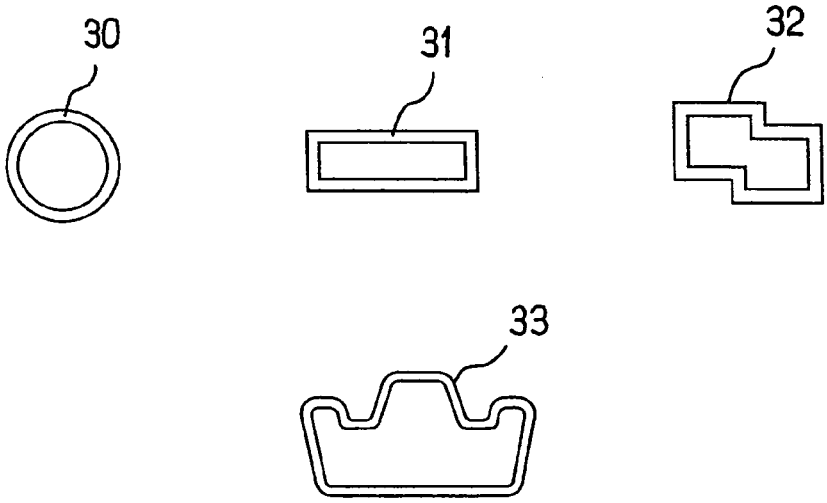
FIGS. 3A-D illustrate schematically various possible sections of plated armors.

FIG. 3 illustrates, by way of examples in FIGS. 3A, B, C and D respectively, four types of possible cross section of the plated armor wires. The round shape 30 of FIG. 3A is the simplest, but it is also possible to envision a rectangular shape 31 of FIG. 3B or a "zeta" shape 32 of FIG. 3C or a "theta" shape 33 of FIG. 3D, these shapes for constituting the pipe reinforcement wires being conventional per se.

The invention claimed is:

1. A process for manufacturing plated-steel wire in which a plating coating is intimately bonded by high pressure to a steel core, the method comprising selecting steel for the core having relatively moderate mechanical properties with a strength $R_m$ of between 800 and 900 MPa and being a hardenable steel, applying a plating metal coating to the core, wherein the plating metal is chosen from the group consisting of titanium and titanium alloys, stainless steel, nickel and nickel alloys, and selecting the materials of the core and of the coating so that the difference between their respective mechanical strength $R_m$ properties is not greater than 200 MPa; and intimately bonding the coating to the core forming a plated wire and applying a rapid high-temperature hardening step to the plated wire, which is accompanied by a controlled martensitic transformation, and then applying a tempering step to the wire.

2. The process as claimed in claim 1, wherein the properties of the steel and of the plating coating, and also the time duration and temperature of the hardening step are chosen with reference to the properties of the steel and the coating to raise the mechanical properties of the hardened wire without destroying the strength of the plating bond between the core and the coating.

3. The process as claimed in claim 2, wherein the high-temperature hardening step is carried out at a temperature of around 800° C. to 1100° C.

4. The process as claimed in claim 3, wherein the high-temperature hardening step is carried out for a time period of a few seconds to a few minutes.

5. The process as claimed in claim 1, wherein the high-temperature hardening step is carried out by induction.

6. The process as claimed in claim 4, wherein the tempering is carried out for a time of between 10 min and 20 min.

7. The process as claimed in claim 1, further comprising performing an intermediate tempering step before the rapid hardening step.

8. The process as claimed in claim 1, wherein the high-temperature hardening step is carried out at a temperature of around 800° C. to 1100° C.

9. The process as claimed in claim 1, wherein the high-temperature hardening step is carried out for a time period of a few seconds to a few minutes.

10. The process as claimed in claim 9, wherein the tempering is carried out for a time of between 10 min and 20 min.

* * * * *